United States Patent [19]

Hatagishi

[11] Patent Number: 4,957,449

[45] Date of Patent: Sep. 18, 1990

[54] CONNECTOR HOUSING UNIT HAVING THREADED FASTENER

[75] Inventor: Yuji Hatagishi, Shizuoka, Japan

[73] Assignee: Yazaki Corporation, Tokyo, Japan

[21] Appl. No.: 436,986

[22] Filed: Nov. 15, 1989

[30] Foreign Application Priority Data

Nov. 18, 1988 [JP] Japan ..... 63-149744[U]

[51] Int. Cl.[5] ..... H01R 13/627

[52] U.S. Cl. ..... 439/364; 403/12; 403/22

[58] Field of Search ..... 439/359, 360, 361, 362, 439/363, 364; 411/916; 403/12, 13, 22

[56] References Cited

U.S. PATENT DOCUMENTS

| | | | |
|---|---|---|---|
| 3,732,525 | 5/1973 | Henschen et al. | 439/364 X |
| 3,853,381 | 12/1974 | Morningstar | 439/364 |
| 4,627,759 | 12/1986 | Kato et al. | 439/364 X |
| 4,629,351 | 12/1986 | Kato et al. | 439/488 X |

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

A connector housing unit for an electrical connector having a threaded fastener including a bolt and a nut. The bolt is provided in an outer connector housing of the connector housing unit and the nut is provided in an inner connector housing. A tentative fastening device and a tentative stoppage device are provided on the connector housings and located in such positions that the component parts of the tentative fastening device are engaged with each other at the same time as the component parts of the tentative stoppage device are engaged with each other. The bolt can move within a prescribed range in the axial direction of the bolt as the connector housings remain tentatively fastened to each other. Therefore, the threads of the bolt and the nut will not be damaged if the tentatively fastened connector housings are pried relative to each other.

5 Claims, 1 Drawing Sheet

CONNECTOR HOUSING UNIT HAVING THREADED FASTENER

BACKGROUND OF THE INVENTION

The present invention relates to a connector housing unit for an electrical connector in which a threaded portion of a fastener for fastening together the connector housings of the unit is not damaged by prying the connector housings relative to each other while the housings remain tentatively fastened to each other.

FIG. 4 shows a conventional connector housing unit having a threaded fastener comprising an outer connector housing 1, an inner connector housing 2, a bolt 3 and a nut 5. A plurality of male terminal metals or prongs 4 are fitted in the outer connector housing 1. The outer connector housing 1 has a cylindrical portion 1*a* surrounding the male terminal metals 4. A through-hole 1*c* is provided in the central portion of the outer connector housing 1 and extends in the direction of mutual fitting of the outer and the inner connector housings 1 and 2. The bolt 3 is inserted in the through-hole 1*c*. The bolt 3 includes a flange 3*b* on the head 3*a* of the bolt, a thin portion 3*c*', which is located inside the inner end of the through-hole 1*c*, and a threaded portion 3*d* extending from the thin portion to the tip of the bolt. A stopper 3*e* such as a snap ring is fitted on the thin portion 3*c*'. The flange 3*b* and the stopper 3*e* prevent the bolt 3 from moving in the axial direction thereof. The inner connector housing 2 has a through-hole 2*c* in the central portion of the housing. The nut 5 is secured within the through-hole 2*c*. When the inner connector housing 2 is manufactured by injection molding, the nut 5 is embedded in the material of the housing so that the nut is secured therein. When the outer and the inner connector housings 1 and 2 are to be fastened to each other, the inner connector housing is inserted into the cylindrical portion 1*a* of the outer connector housing, and the tip of the bolt 3 is placed into contact with the nut 5 so that the housings are tentatively fastened to each other. The bolt 3 is thereafter turned to be threadedly engaged into the nut 5 to fully fasten the connector housings 1 and 2 to each other by the screwing force on the bolt and the nut. Since the bolt 3 is prevented from moving in the axial direction thereof, the outer and inner connector housings 1 and 2 can be easily pried relative to each other in the directions B, as shown in FIG. 4, when the housings are tentatively fastened to each other. Therefore, a problem exists in that the screw thread of the bolt or the nut 5 is likely to be damaged by the prying.

SUMMARY OF THE INVENTION

The present invention was made in order to solve the above-mentioned problem.

Accordingly, it is an object of the present invention to provide a connector housing unit having a threaded fastener including a bolt and a nut in which the screw threads of the bolt and the nut are unlikely to be damaged.

The bolt is provided in one connector housing of the connector housing unit. The nut is provided in the other connector housing of the unit. A tentative fastening means and a tentative stoppage means are provided on the connector housings and located in such positions that the component parts of the tentative fastening means are engaged with each other at the same time as the component parts of the tentative stoppage means are engaged with each other. The bolt can move within a prescribed range in the axial direction of the bolt as the connector housings remain tentatively fastened to each other. Therefore, the screw threads of the bolt and the nut are prevented from being damaged by prying the tentatively fastened connector housings relative to each other. The tentative fastening means also allows the connector housings to be easily fastened to each other with a single hand.

DETAILED DESCRIPTION OF THE PREFERRED EMBODIMENT

An embodiment of the present invention is hereafter described in detail with reference to the drawings attached hereto.

Figure 1:
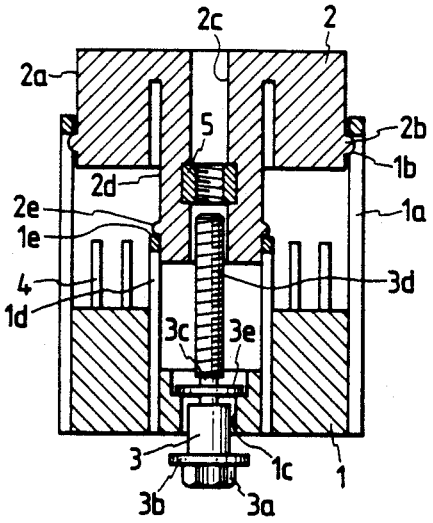
FIG. 1 is a longitudinal sectional view of a connector housing unit having a threaded fastener according to an embodiment of the present invention.

FIG. 1 shows a connector housing unit having a threaded fastener. The unit comprises an outer connector housing 1, an inner connector housing 2, which is fitted in the former, a bolt 3, and a nut 5. A plurality of male terminal metals or prongs 4 are fitted in the outer connector housing 1. The outer connector housing 1 has a cylindrical peripheral portion 1*a* surrounding the male terminal metals. A fastening groove 1*b*, which is a portion of a tentative fastening means, is formed in the inside surface of the cylindrical peripheral portion 1*a* near the tip thereof. A through-hole 1*c* is provided in the central thick portion of the outer connector housing 1, and extends in the direction of fastening of the outer and inner connector housings 1 and 2. The bolt 3 is inserted in the through-hole 1*c*. The outer connector housing 1 has a small cylindrical portion 1*d* located around the through-hole 1*c* and extending in the direction of fastening of the housings 1 and 2.

The bolt 3 includes a flange 3*b* on the head 3*a* thereof. A thin portion 3*c* of the bolt 3 is located inside the inner end of the through-hole 1*c* and is larger in axial length than the thin portion of the bolt of the conventional connector housing unit. Further, the bolt 3 includes a threaded portion 3*d* extending from the thin portion to the tip of the bolt. A stopper 3*e*, such as a snap ring, is fitted on the thin portion 3*c*. The flange 3*b* and the stopper 3*e* restrict the movement of the bolt 3 in the axial direction thereof. Since the thin portion 3*c* is made larger in axial length than that of the bolt of the conventional connector housing unit, the bolt 3 of the subject embodiment can move in the axial direction thereof.

Female terminal metals (not shown) are fitted in the inner connector housing 2 so as to be electrically coupled to the male terminal metals 4. The inner connector housing 2 is positioned in the cylindrical portion 1*a* of the outer connector housing 1 in such a manner that the male terminal metals 4 are fitted in the female terminal metals and thereby electrically coupled thereto.

A fastening projection 2*b*, which is the other portion of the tentative fastening means, is provided on the peripheral portion 2*a* of the inner connector housing 2 so that the projection is engaged in the fastening groove 1*b*. A through-hole 2*c* is provided in the central, thick cylindrical portion 2*d* of the inner connector housing 2. The nut 5 is secured in the through-hole 2*c*. The central, thick cylindrical portion 2*d* of the inner connector housing 2 extends toward the outer connector housing 1 and is fitted in the small cylindrical portion 1*d* thereof. A projection 2*e* is provided on the peripheral surface of the central, thick cylindrical portion 2*d* near the tip thereof so that the projection 2*e* and the tip 1*e* of the small cylindrical portion 1*d* are placed into contact with each other to constitute a tentative stoppage means. It is preferable that the groove 1*b* and the projection 2*b*, which constitute the tentative fastening means, can be easily engaged with each other by hand or the like. However, the projection 2*e* and the tip 1*e*, which constitute the tentative stoppage means, cannot be moved past each other by hand or the like, but by the tightening force on the bolt 3 and the nut 5 through the use of an impact wrench.

Figure 2:
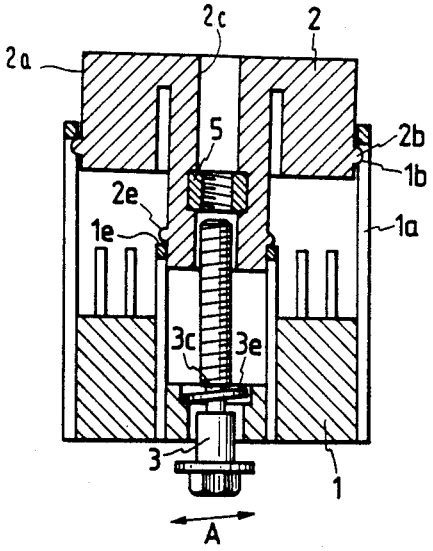
FIG. 2 is a longitudinal sectional view of the unit in the state whereby the tentatively fastened outer and inner connector housings are pried relative to each other.

The operation of the connector housing unit will now be described in detail. After the mutual fastening of the outer and the inner connector housings 1 and 2 is started, the projection 2*b* is engaged in the groove 1*b* so that the connector housings are tentatively fastened to each other as shown in FIG. 2. At that time, the tip 1*e* of the small cylindrical portion 1*d* and the projection 2*e* are placed into contact with each other so that the movement of the connector housings 1 and 2 toward one anther is tentatively stopped.

Since the groove 1*b* and the projection 2*b*, thus engaged with each other to constitute the tentative fastening means, prevent the outer connector housing 1 from coming off the inner connector housing 2, the housings can thereafter be handled with a single hand. Further, even if the outer connector housing 1 is then pushed upward, the tentative stoppage means, constituted by the tip 1*e* of the small cylindrical portion 1*d* and the projection 2*e*, prevents the mutual fastening of the connector housings 1 and 2 from being advanced.

At the above-mentioned time, the mutual connection of the male terminal metals 4 and the female terminal metals is not yet started. Further, the bolt 3 can move back and forth in the axial direction thereof due to the relatively long thin portion 3*c* thereof so as not to collide against the nut 5 even if the outer connector housing 1 is pried relative to the inner connector housing 2 in the directions A as shown in FIG. 2. Accordingly, the screw threads of the bolt and the nut are unlikely to be damaged. Since the present invention limits the amount of prying taking place between the connector housings by means of the tentative stoppage means 2*e* and 1*e* as compared to that of the conventional connector housing unit, the inventive connector housings are prevented from being damaged.

Figure 3:
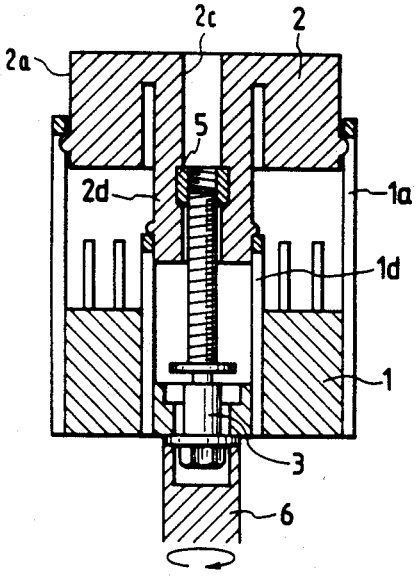
FIG. 3 is a longitudinal sectional view of the unit in the state whereby the engagement of the screw threads of the bolt and nut is started.
Figure 4:
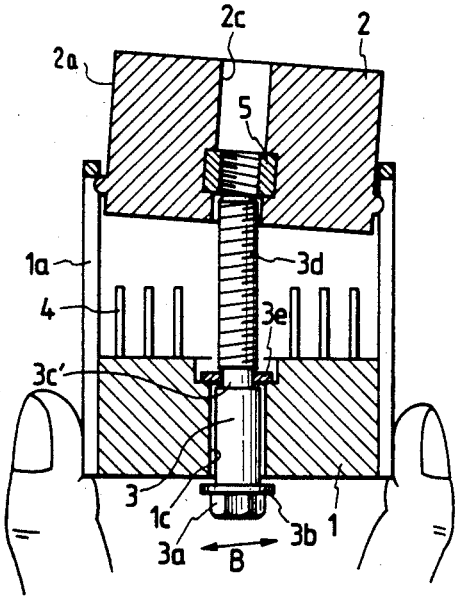
FIG. 4 PRIOR ART
FIG. 4 is a longitudinal sectional view of a conventional connector housing unit having a threaded fastener.

After the outer and the inner connector housings 1 and 2 are tentatively fastened to each other, the tightening of the bolt 3 and the nut 5 is started as shown in FIG. 3. At that time, the bolt 3 is pushed up by an impact wrench 6 so that the bolt comes into contact with the nut. The impact wrench 6 is then turned so that the engagement of the screw threads of the bolt 3 and the nut 5 is started. The tip 1*e* of the small cylindrical portion 1*d* is then moved further beyond the projection 2*e* by the tightening force on the bolt 3 and the nut 5 so that the connector housings 1 and 2 are fully fastened to each other.

Although the tentative stoppage means 1*e* and 2*e* is put into action at the same time as the mutual engagement of the tentative fastening means 1*b* and 2*b* in the embodiment, the tentative stoppage means may be put into action when the mutual fastening of the connector housing 1 and 2 is slightly advanced after the mutual engagement of the tentative fastening means.

The tentative fastening means and the tentative stoppage means may both be provided at the peripheral portion 2*a* of the inner connector housing 2 and the cylindrical peripheral portion 1*a* of the outer connector housing 1, or both provided at the small cylindrical portion 1*d* of the outer connector housing and the central cylindrical portion 2*d* of the inner connector housing. In addition, the tentative fastening means may be provided at the small cylindrical portion 1*d* of the outer connector housing 1 and the central cylindrical portion 2*d* of the inner connector housing 2, and the tentative stoppage means may be provided at the peripheral portion 2*a* of the inner connector housing and the cylindrical peripheral portion 1*a* of the outer connector housing, i.e., conversely to the embodiment.

What is claimed is:

1. A connector housing unit for an electrical connector having a threaded fastener, said connector housing unit comprising:
   - a bolt disposed in a first connector housing;
   - a nut disposed in a second connector housing; and
   - a tentative fastening means having a first set of component parts and a tentative stoppage means having a second set of component parts provided on said first and second connector housings and positioned such that said first set of component parts of said tentative fastening means are engaged with each other at the same time as said second set of component parts of said tentative stoppage means are engaged with each other; wherein said bolt is axially movable within a prescribed range to be engaged with said nut as said first and second connector housings remain tentatively fastened to each other.

2. A connector housing unit according to claim 1, further wherein said first connector housing comprises an inner portion having a plurality of male terminal metals extending therefrom and a cylindrical peripheral portion surrounding said male terminal metals, and said second connector housing comprises a cylindrical member adapted to be fitted within said cylindrical peripheral portion.

3. A connector housing unit according to claim 2, further wherein said first set of component parts of said tentative fastening means comprise a projection provided on a peripheral portion of said cylindrical member and a groove formed in said cylindrical peripheral portion for engagement with said projection.

4. A connector housing unit according to claim 2, further wherein said first connector housing includes a first axial hole for said bolt in a center portion thereof, and a small cylindrical portion surrounding said first hole and extending from said inner portion; and said second connector housing includes a second axial hole having said nut positioned therein, and a central cylindrical portion surrounding said second hole and extending from said second connector housing and adapted to be fitted within said small cylindrical portion.

5. A connector housing unit according to claim 4, further wherein said second set of component parts of said tentative stoppage means comprise a second projection provided on a peripheral surface of said central cylindrical portion and a groove formed said small cylindrical portion.

* * * * *